United States Patent [19]

Harrison

[11] 4,198,731

[45] Apr. 22, 1980

[54] CARDING MACHINE CLEANING APPARATUS

[75] Inventor: John E. Harrison, Greenville, S.C.

[73] Assignee: John D. Hollingsworth on Wheels, Inc., Greenville, S.C.

[21] Appl. No.: 958,792

[22] Filed: Nov. 8, 1978

Related U.S. Application Data

[63] Continuation of Ser. No. 847,417, Oct. 31, 1977, abandoned.

[51] Int. Cl.[2] ..... D01G 15/76

[52] U.S. Cl. ..... 19/107

[58] Field of Search ..... 19/106 R, 107, 109; 209/133, 134, 135; 55/302

[56] References Cited

U.S. PATENT DOCUMENTS

| | | | |
|---|---|---|---|
| 2,284,750 | 6/1942 | Landreth | 19/107 X |
| 3,283,366 | 11/1966 | Kalwaites | 19/106 R |
| 3,315,320 | 4/1967 | Bass et al. | 19/107 |
| 3,387,336 | 6/1968 | Crowley | 19/107 |
| 3,553,791 | 1/1971 | King | 19/107 |

*Primary Examiner*—Louis Rimrodt

*Attorney, Agent, or Firm*—Bailey, Dority & Flint

[57] ABSTRACT

A carding machine cleaning apparatus is illustrated wherein an elongated plenum, open at both ends, is positionable between a closure member on one side of a carding machine and a suction housing having an opening therein on the other side in such a manner that the suction is automatically disconnected by moving the plenum out of alignment with the closure and suction housing opening and re-established by returning the plenum to position between the closure and the suction housing. The cleaning apparatus is especially useful when aligned above a number of transverse carding rolls of a carding apparatus so that each respective housing is removable for inspection of a portion of the carding apparatus.

9 Claims, 3 Drawing Figures

CARDING MACHINE CLEANING APPARATUS

This is a continuation, of application Ser. No. 847,417, filed Oct. 31, 1977, now abandoned.

BACKGROUND OF THE INVENTION

A variety of suction apparatus has been developed in recent years to permit cleaning of desired points and areas of carding apparatus of all types. In most instances, such suction cleaning apparatus includes cleaning slots and nozzles which are in fixed positions. Certain cleaning apparatus have removable cleaning elements such as those illustrated in U.S. Pat. Nos. 3,315,320 and 3,387,336. In such instances the pivoted cleaning mechanism are merely hoods and the pivoted movement of the element does not operate to disconnect the suction.

It is desirable to disconnect the source of suction when displacing cleaning elements for inspection purposes. In many instances, it is necessary to disconnect various fittings and bolts when removing the cleaning apparatus for inspection and for cleaning the apparatus and associated carding areas.

SUMMARY OF THE INVENTION

It has been found that cleaning apparatus may be provided for carding machines which is capable of being lifted or pivoted out of alignment with the closure member on one end on one side of the card, and an opening in a housing supplying suction on the other side of the card. By simply replacing the plenum between the closure member and the suction source in proper alignment, the device is automatically restored to operation thus facilitating the inspection and cleaning without the necessity of further connection or disconnection.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
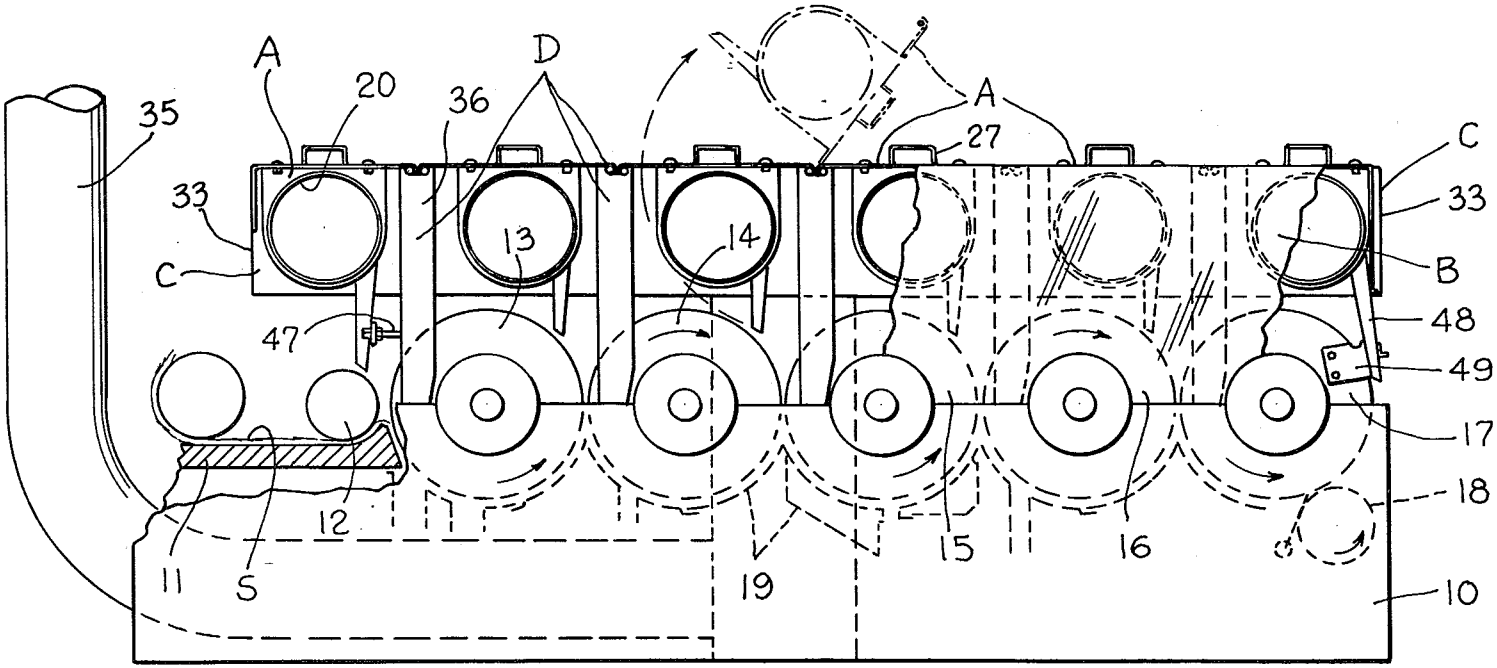
FIG. 1 is a schematic side elevation with parts omitted and parts broken away illustrating a carding apparatus equipped with cleaning mechanism constructed in accordance with the present invention.

The drawing illustrates a carding machine cleaning apparatus including an elongated plenum A open on both ends and having a longitudinal suction slot therein. A closure member B is carried adjacent a side of the carding machine. A suction housing C is carried adjacent the other side of the carding machine having a suction opening therein. Support means D are provided for removably positioning the plenum in cleaning relation transversely of the carding machine closely adjacent and in alignment with the closure member on one end and closely adjacent and in alignment with the suction opening on the other end to establish suction in the plenum for cleaning of the carding machine through the suction slot. Thus, the plenum may be moved out of such alignment to discontinue suction cleaning and permit inspection after which the plenum may be moved back into such alignment to restore suction in the plenum.

A carding machine is illustrated having a pair of transversely spaced side frame members 10 which carry therebetween in transverse aligned relationship, a number of rolls equipped with card clothing. A feed plate 11 supplies suitable fibrous stock S by means of the feed roll 12 to a transverse roll or cylinder 13 which acts as a licker-in. The fibrous stock passes beneath the roll 13 and over the cylinder 14 which receives the stock passing the stock under the cylinder 15. The stock then passes over the roll 16 which acts as a stripper for the cylinder and thence under a doffer roll 17 from whence the web is doffed by a suitable doffing mechanism 18, which may be of the type illustrated in U.S. Pat. No. 3,283,366. It will be noted that suitable cover members 19 which may include plates or various other carding elements may be provided for controlling or carding the stock in connection with each of the rolls mentioned above when carrying out a carding operation. The showing of such elements at the top of the rolls has been omitted for clarity of illustration.

Each of the elongated plenums A are illustrated as including a cylindrical conduit 20 having a longitudinal slot 21 disposed in a desired location for accommodating a nozzle 22 which may concentrate the suction force adjacent a desired area of the carding apparatus. The conduit 20 is attached to a tangential cover plate 23, which is illustrated as being horizontally disposed and secured as by an L-shaped bracket 24 which has an opening 25 therein within which the conduit may be tack welded. The plenum assembly may then be secured together as by bolts 26 which pass through the respective ends of the plate 23 and respective outturned horizontal legs of the angle members 24. The conduit may thus be provided with angles 24 and associated attachments adjacent each end for properly fastening the assembly together. Handles 27 may be provided at each end for removing the assembly thus described in a manner which will be described in greater detail below.

The closure member B is removably secured in fixed position adjacent a side frame member of the carding apparatus and includes flanges 28 for this purpose. The closure member B may assume any desired form, but it is important that it fit snugly when the plenum A is in alignment therewith to cut off or severely limit the intake of air therein so as to function as a closure.

Figure 2:
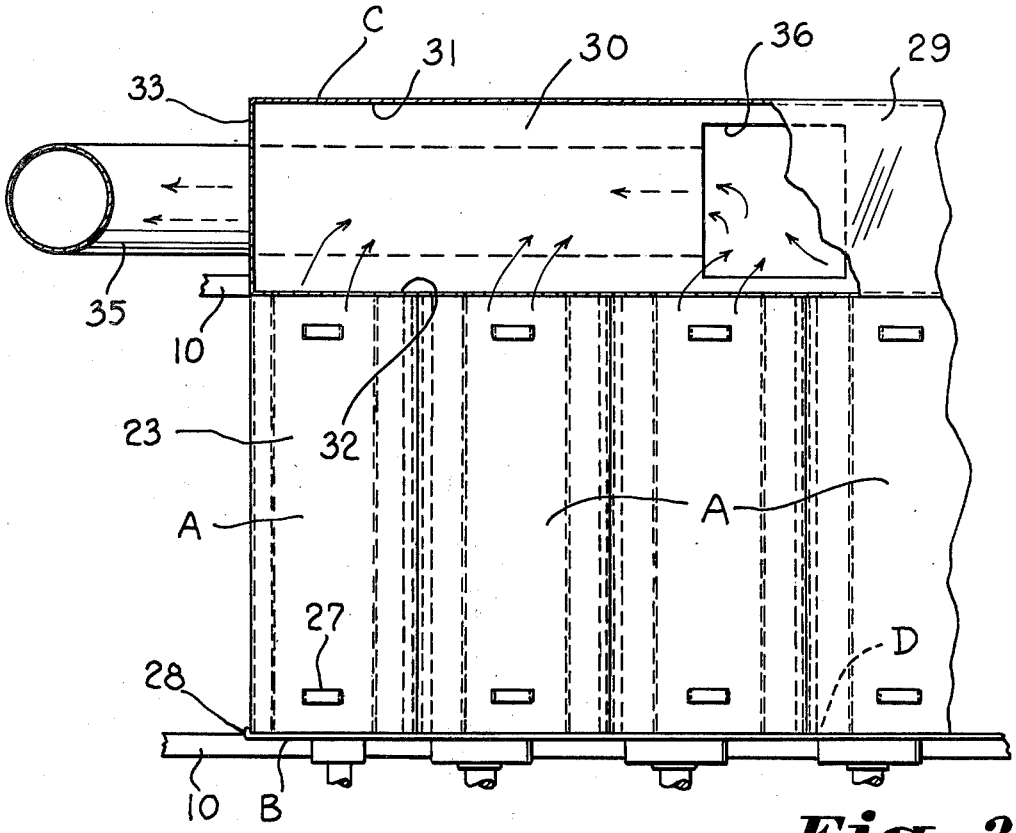
FIG. 2 is an enlarged top plan view, with parts broken away further illustrating the cleaning apparatus illustrated in FIG. 1.
Figure 3:
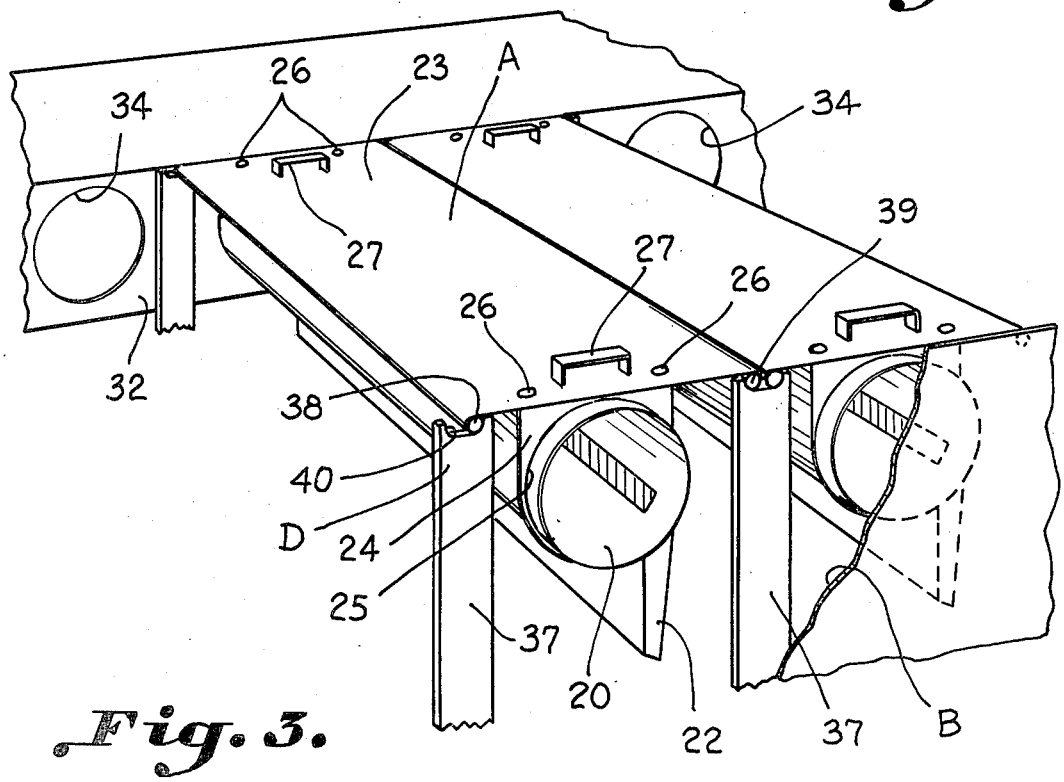
FIG. 3 is an enlarged perspective view further illustrating a plenum constructed in accordance with the present invention.

The suction housing C, as is best illustrated in FIG. 2, includes a top 29, a bottom 30 and side walls 31 and 32. Suitable closures 33 are provided for limiting the flow of air into the housing to a flow through spaced, aligned openings 34 opposite the closure means B and in alignment with the conduit when the plenum is positioned for suction cleaning. Thus, the plenum which is open at both ends, is provided with closure means at one end and means for receiving suction at the other end by virtue of its positioning between the closure and opening 34 within the suction housing C. The suction housing C is supplied with suction from a suitable source through the conduit 35 which is connected to a vertically disposed suction plenum 36 supplying a source of suction to the suction housing C.

Support means D are provided for removably positioning the plenum and are illustrated as including a plurality of spaced standards 37 and a pair of opposed bars 38 and 39 carried along the sides of the cover members 23 of each plenum A. The sides of the cover 23 are illustrated as being turned downwardly to encompass the bars 38 and 39. It will be noted that each of the standards 37 have a recessed open receiving space 40 for preferably accommodating an adjacent pair of bars. It will be noted in FIG. 1 that the plenum A adjacent the feed plate 11, has pivotal means supplied by one of the bars 39 while a stop 47 is carried adjacent the nozzle 22 for bearing upon a standard 37 acting as a stop means. On the other end of the carding apparatus a downwardly disposed nozzle 48 acts as a stop when bearing upon stop portions 49 carried by the frame members 10.

Thus, each of the plenums A may be removed separately by pivoting about a pivot means carried adjacent a side thereof or by removal entirely from the support mechanism as by lifting off the plenum from the carding apparatus. Thus, inspection is greatly facilitated, permitting automatic disconnections of the suction arrangement by merely moving the suction plenum. An especially desirable arrangement is achieved when the carding apparatus includes a number of rolls as illustrated, but the device may be used individually in connection with conventional carding apparatus at one or more locations thereon.

While a preferred embodiment of the invention has been described using specific terms, such description is for illustrative purposes only, and it is to be understood that changes and variations may be made without departing from the spirit or scope of the following claims.

What is claimed is:

1. A cleaning apparatus for a machine having aligned rolls covered with card clothing comprising:

an upright closure member fixed adjacent a side of said machine;

a suction housing fixed adjacent the other side of said machine having a suction opening therein;

an elongated plenum open on both ends and having a longitudinal suction slot therein;

support means for removably positioning said plenum in cleaning relation transversely of the carding machine closely adjacent and in alignment with said closure member on one end and closely adjacent and in alignment with the suction opening on the other end to establish suction in said plenum for cleaning of the carding machine through said suction slot; and said support means including open receiving members fixed adjacent each side of said machine permitting the plenum to be removed therefrom and then replaced therein;

whereby said plenum may be moved out of said alignment to discontinue suction cleaning and permit inspection after which said plenum may be moved back into said alignment to automatically restore suction in said plenum by replacing said plenum.

2. The structure set forth in claim 1 including, a suction nozzle extending from said suction slot to concentrate the suction action of the plenum adjacent a selected portion of the machine.

3. The structure set forth in claim 2 wherein said support means includes pivoted means for pivotally moving said plenun out of said alignment.

4. The structure as set forth in claim 3 wherein said support means includes, a stop opposite said pivoted means, and said open receiving members are spaced for said pivoted means and stop permitting the plenum to be removed out of said alignment away from the machine.

5. The structure set forth in claim 4 wherein said pivoted means and said stop comprise opposed bars extending outwardly from each end of said plenum, and wherein said spaced open receiving members include stands spaced longitudinally of the machine.

6. Cleaning apparatus for use in a machine have a plurality of transverse rolls clothed with card clothing comprising:

a plurality of elongated plenums open on both ends and having a longitudinal suction slot therein carried above adjacent rolls;

a closure member carried adjacent a side of said machine;

a suction housing carried adjacent the other side of said machine having a plurality of longitudinally spaced suction openings therein; and support means for removably positioning said plenums in cleaning relation transversely of the machine closely adjacent and in alignment with said closure member on one end and closely adjacent and in alignment with the suction openings on the other end to establish suction in said plenums for cleaning of the machine through said suction slot;

whereby each of said plenums may be moved out of said alignment to discontinue suction cleaning and permit inspection after which said plenums may be moved back into said alignment to restore suction therein.

7. The structure set forth in claim 6 including, a suction nozzle extending from said suction slot of each plenum;

pivoted means for pivotally moving each plenum out of said alignment;

a stop opposite each said pivoted means; and spaced open receiving members for said pivoted means and stop permitting the plenums to be removed out of said alignment away from the machine.

8. The structure set forth in claim 7 wherein said pivoted means and said stops comprise opposed bars carried adjacent sides of said plenums, and wherein said spaced open receiving members include stands spaced longitudinally of the machine.

9. The structure set forth in claim 8 wherein intermediate stands each support adjacent bars of adjacent plenums for independently pivoting and removing adjacent plenums.

* * * * *